US005778468A

United States Patent [19]

Saarela et al.

[11] Patent Number: 5,778,468

[45] Date of Patent: Jul. 14, 1998

[54] PILLOW-TOTE-ANGELIC COMPANION

[76] Inventors: Janis Edith Saarela; Kristi Kay Saarela, both of 4210 E. 200 St., Prior Lake, Minn. 55372

[21] Appl. No.: 714,588

[22] Filed: Sep. 16, 1996

[51] Int. Cl.[6] ..... A47G 9/02

[52] U.S. Cl. ..... 5/636; 5/639; D6/601

[58] Field of Search ..... 5/636, 639, 640, 5/645; 446/71, 72, 365; D6/597, 598, 599, 601

[56] References Cited

U.S. PATENT DOCUMENTS

| | | | |
|---|---|---|---|
| 1,221,890 | 4/1917 | Millar | 5/696 |
| 2,405,434 | 8/1946 | Bailhe | 5/907 X |
| 3,789,546 | 2/1974 | Morrison | 5/485 X |
| 4,091,481 | 5/1978 | Redman | D6/597 X |
| 4,277,859 | 7/1981 | Seaman | 5/639 |
| 4,309,784 | 1/1982 | Cohen . | |
| 4,535,878 | 8/1985 | Grahl . | |
| 4,763,369 | 8/1988 | Spector . | |
| 4,768,245 | 9/1988 | Dutton | D6/601 |
| 4,853,994 | 8/1989 | Ekstein | 5/639 |
| 4,874,340 | 10/1989 | Smallwood . | |
| 4,968,279 | 11/1990 | Smith | 5/640 X |
| 5,027,457 | 7/1991 | Sweet . | |
| 5,115,528 | 5/1992 | Lamle . | |
| 5,118,318 | 6/1992 | Lorizio . | |
| 5,184,362 | 2/1993 | Yager et al. . | |
| 5,437,070 | 8/1995 | Rempp | 5/640 X |
| 5,638,561 | 6/1997 | Sperry et al. | 5/907 X |

*Primary Examiner*—Michael F. Trettel
*Attorney, Agent, or Firm*—Kinney & Lange, P.A.

[57] ABSTRACT

Base unit of child's Pillow-Tote-Angelic Companion is a fabric-made embodiment of a billowy, white cloud upon which a golden star and crescent moon have been attached. Configuration is such that: there is created, in the concave behind the moon, a hammock-like "dwelling place" for a detached, individualized, characterized toy angel; "cloud formation" (contour) differs from unit to unit. Such "cloud" pillow, together with books and small toys stored in an elasticized rear pocket, may be carried from place to place by its fabric handle.

10 Claims, 2 Drawing Sheets

FIG. 3-a
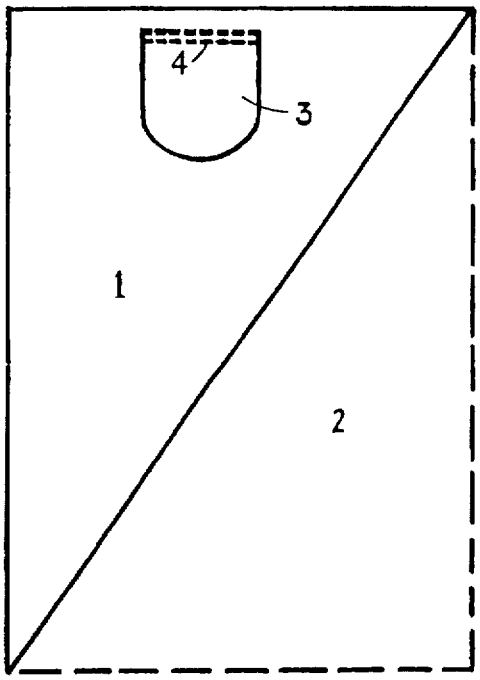
FIG. 3-b
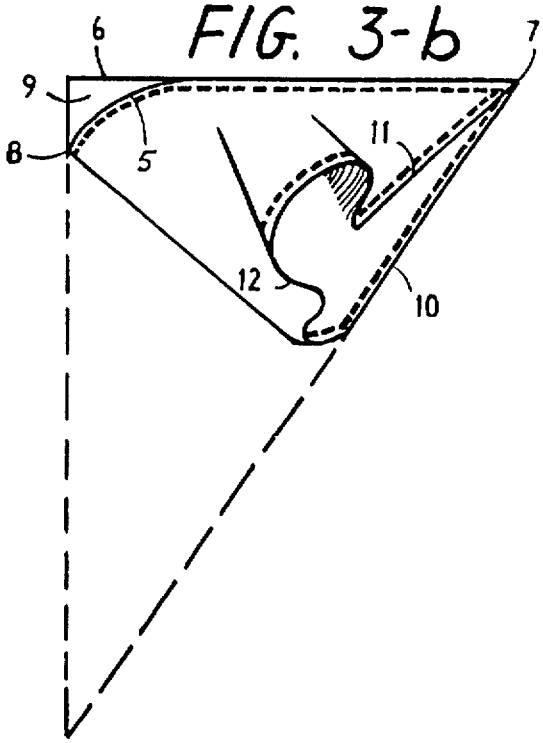
FIG. 4
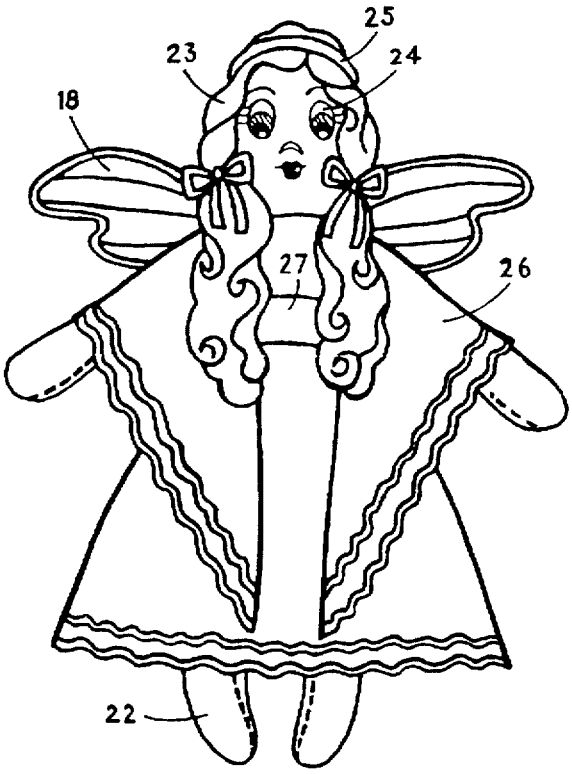
FIG. 5
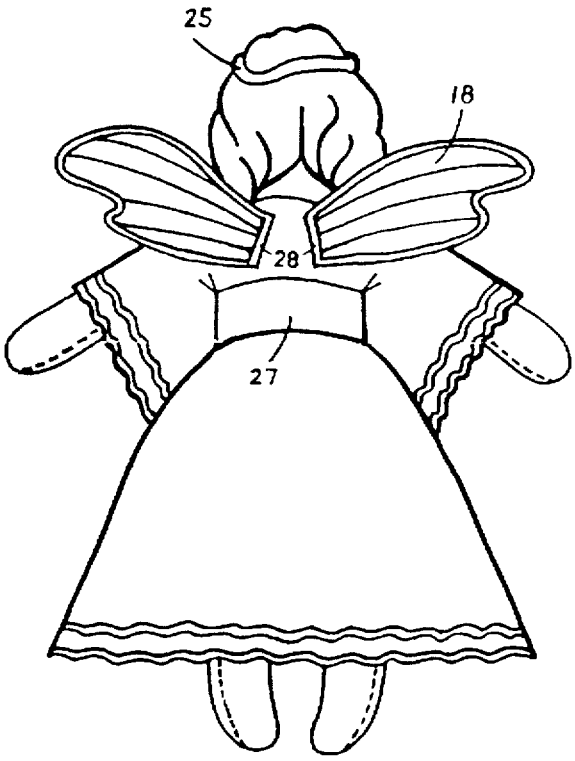

PILLOW-TOTE-ANGELIC COMPANION

BACKGROUND OF THE INVENTION

As it relates to children, the prior art has produced numerous pillows which function as a plaything, a storage case for books and small toys, a source of physical comfort and visual attractiveness. The present invention combines all such uses, but for a purpose and in an embodiment not previously devised.

Children, by their very nature, are fascinated by the sky, weather and the heavens. No pillow of the prior art simulates a moon, star and entire cloud.

The primary objective of the present invention is to give the child an awareness of God's watchcare, evidenced by the nearness of winged angels.

Another primary objective is to effectuate feelings of safety and security, achieved through 1) a sense of angelic companionship; 2) the inclination of children to become attached to an object that is soft and cuddlesome.

A further primary objective is to encourage a timely nap and bedtime. The star, moon and pajama-type gown worn by the angel suggest night/slumber. Storybooks contained within give enjoyment to a restful activity.

Yet another primary objective is to accentuate individuality. The child chooses angelic gender and facial personality, color and style of hair, and representative accessory such as a baseball cap. The child receives, therefore, a symbol of his own identity.

By means of graphic tie to family, one doll-pillowcase, U. S. Pat. No. 5,118,318, was specifically designed to fulfill a child's need for security. The present invention makes a similar claim, but from an entirely different perspective, that is, by virtue of divine protection. There is need in both the religious and secular marketplace for toys that instill interest in a Supreme Being.

Drawings and descriptions included herein explain more fully the preceding and other objectives of the present invention.

SUMMARY OF THE INVENTION

Child's Pillow-Tote-Angelic Companion has instant recognition: it looks and feels like a fluffy, white cloud. The exterior is irregularly shaped, and made of a fabric type that swirls and glistens. The interior is filled with polyester.

Features inherent to the cloud—soft, lightweight, inspiring, serene—are the same features that (in view of purpose) give effect to the invention.

The pillow/base unit, with a finished size of approximately 24 inches in width and 12–15 inches in height, is sufficient in size to support the head, arms and upper body of a small child. An attached star and crescent moon, made with an iridescent gold material, do not detract from comfortableness. Both are, in fact, lightly padded and a complement to other swells and protrusions on the "cloud" surface. The entire unit is washable.

The fabric handle sewn to the top allows the unit to be carried. An elasticized pocket at center back provides a place to put favorite books and small toys. Pillow-Tote-Angelic Companion, therefore, is a toy of multi-uses: nighttime pillow, daytime plaything, naptime "take-along" and traveltime amusement.

Key to the invention is the muslin angel that "dwells" in the hollow area just behind the moon. This is not just any angel, but one selected specially by and for the child.

Features of choice include: gender, facial expression, color and style of hair, type of accessory.

In the preferred embodiment there is imprinted on the base unit a Bible verse (Psalms 91:11) which indicates that angels are heaven sent. Such assurance, together with general cuddlesome qualities of the unit, give the child a sense of security and well being. Similarly, the individualized angel is intended to bolster self-identity and sense of belonging.

There is need on the market for toys that have, not only a useful purpose and acceptance by young children, but also a positive influence upon their personal and spiritual lives. Pillow-Tote-Angelic Companion is intended to meet this need.

DESCRIPTION OF DRAWINGS

The scope and spirit of the invention, together with claims of the inventors, will become apparent when referenced to the descriptions and drawings which follow.

FIG. 3-*a*/3-*b* illustrate beginning steps of construction, base unit.

FIG. 4 is a perspective drawing of toy angel, front view.

FIG. 5 is a perspective drawing of toy angel, back view.

DETAILED DESCRIPTION OF THE PREFERRED EMBODIMENT

Figure 1:
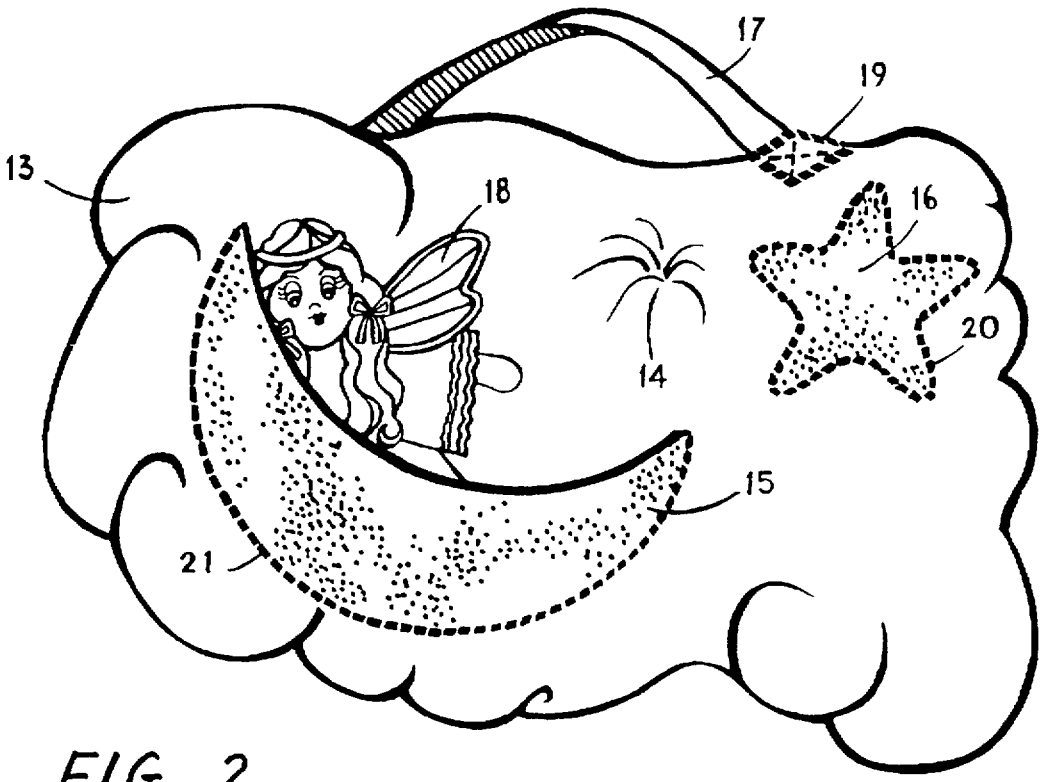
FIG. 1 is a perspective drawing of invention, front view.
Figure 2:
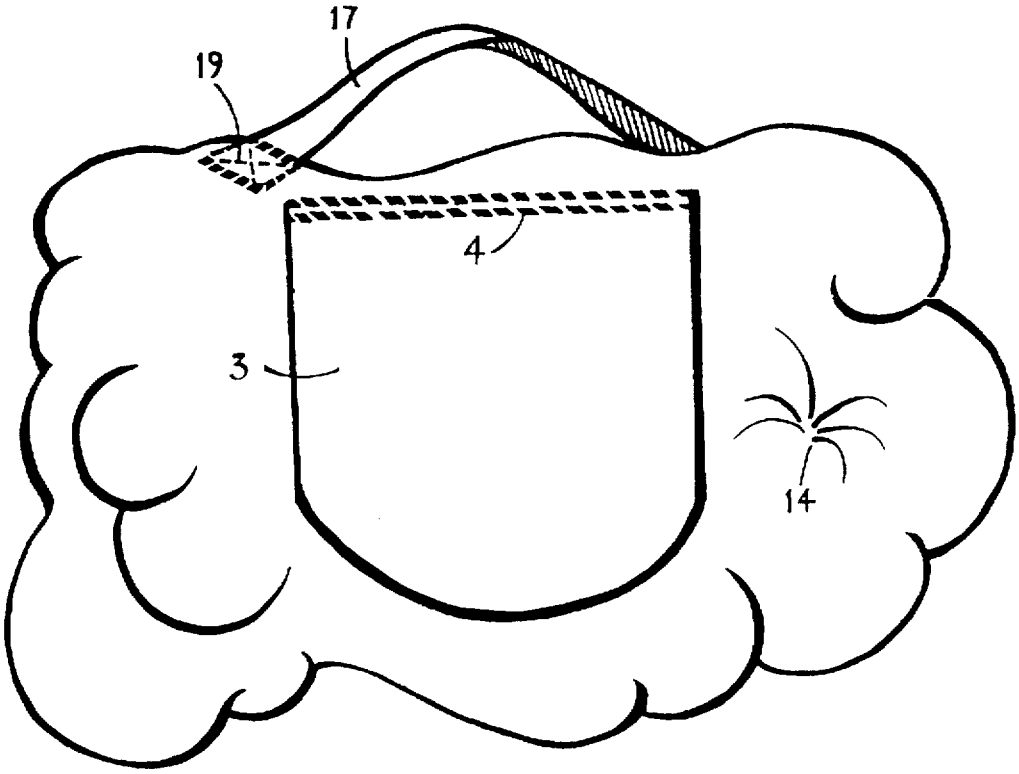
FIG. 2 is a perspective drawing of invention, back view.

In the same way that clouds are unalike, base units of Pillow-Tote-Angelic Companion differ one from another. This is achieved by manipulating individually both the exterior fabric and interior fill. In addition, it is necessary that initial joinings of fabric create bulges and ripples with which to begin. A step-by-step description of the assembly process is hereby given.

A piece of durable, washable fabric, 54 inches wide and 72 inches in length (may be proportionately larger or smaller) is cut in half diagonally (FIG. 3-*a*). This may be quilted satin or, preferably, a material manufactured specially for the invention, that is, for resemblance to a swirling, glistening cloud surface.

Since only one-half the fabric length (1) is needed for base piece, the remaining half (2) may be used to cut pieces (two each) for the back pocket (approx. 13"×13") and handle (11"×2").

Conventional sewing methods are used to construct the pocket/tote (3), generally as follows: two like pieces (one of them backed with polyester batting) are joined (right sides together) and the pocket turned right-side out. One-inch white bias tape is attached by narrow seams (at top and bottom of tape) to upper edge of pocket back; taut three-quarter inch elastic is encased therein (4).

The finished pocket (3) is stitched to the base unit at a location one-inch from upper edge, and slightly to the left of center (FIG. 3-*a*) As in FIG. 3-*a*, a fold is made whereby opposite ends of base piece (with right sides together) are brought together. Edge (5) is pulled outward to Edge (6), and stitching made from Point (7) to Point (8). Excess material (9) is cut away.

Fabric is then re-positioned (held flatly together) so that Edge (10) may be joined with Edge (11), and (except for a four-inch opening) a seam made from Point (7) to halfway point (12). Preferably the two edges shall first be shifted (sideways) to further skew unit form. Termini of seams, such as in the area of Point (12), must be rounded to preserve the cloud-like appearance of the end product.

Tufts of washable polyester fill, 15–20 ounces in total, are then inserted into the seam opening. The unit is ready for shaping when, in general, a pillow-like firmness has been attained.

From the exterior, fabric is tucked, folded, twisted and otherwise manipulated to create desired "cloud formation." From the interior, bulk (extra fill) is added to solidify the peaks, bulges and swells (13), and moved away to allow for cloud-like depressions and hollows.

Heavy-duty white thread is used, from the exterior, to stitch all formations securely and imaginatively into place. More specifically, tacks are made to fasten any elongated protrusion to its adjoining surface. Each swell is encircled, wholly or in part, with blindstitching (visible chiefly from the underside); afterwards the thread is pulled to adjust and better define desired formation. Finally, and in order to deepen/secure each depression (14), thread is inserted through the entire thickness of the unit, pulled tightly from front to back and knotted at each end. Seam opening, between Points (7) and (12), is closed with stitching.

Fabric chosen for the moon (15) and star (16) shall be stretchable, washable, iridescent and gold in hue or color.

The moon (15), star (16), handle (17), and wings of the angels (18) are all assembled in the same manner: two like pieces of fabric, one of them backed with polyester batting/padding, are sewn together and turned right side out (through a seam opening which is afterwards sewn together).

In order to achieve balance, placement of the handle must allow for the unwieldy shape of base unit. Double stitching is used to attach the ends of each handle (19), outer edges of the star (20) and the long bottom edge of the crescent moon (21).

Back-to-front stitching, such as that previously described, creates a cavity or "dwelling place" directly behind the moon for a detached characterized fabric angel. Upturned configuration of such moon, together with stretch of the fabric, confine the angel, and keep it from falling when the unit is held in an upright position.

Portions of the angel are made with doll-making products currently on the market: muslin ragdoll-type body (22), synthetic hair (23), embroidered face (24), gold or silver cording (25) for the halo. Other features are exclusive to the invention: pajama-like gown made with flannel and pastel colors (26), cummerbund of metallic gold or silver fabric (27), metallic or foil set of wings (18) which extend upward from diagonal slits (28) cut at either side of gown (upper back).

For the purpose of this invention, it is the angel that most accentuates individuality. Both male and female angels, therefore, are assembled, each with a differing facial expression, differing color and style of hair, differing accessory. These include, but shall not be limited to hair ribbon, cowboy hat, baseball cap, hat with plume, string of beads, kerchief. Clothing and accessories are securely fastened (with glue or stitching) and cannot be removed.

In the preferred embodiment, one or two Bible verses are affixed, either by label or imprint, upon the base unit. Those specifically chosen are:

"For He orders His angels to protect you wherever you go." Psalms 91:11

"God made two great lights; the greater light to rule the day, and the lesser light to rule the night. He made the stars also." Genesis 1:16

It is recognized that variations and modifications to the foregoing may be apparent to those skilled in the art. We ask, therefore, that the scope and spirit of the invention be determined from the claims which follow rather than the specific descriptions given.

What we claim is:

1. A child's combination pillow and plaything comprising:

a fabric piece shaped as a right triangle having a right angle corner and first and second acute angle corners and first and second adjacent edges extending from the right angle corner to the first and second acute angle corners, respectively, and a hypothenuse edge extending between the first and second acute angle corners and wherein the adjacent edges are of differing lengths, the adjacent edges being peripherally aligned and stitched together the first and second acute angle corners having first been aligned such that due to the differing lengths of the adjacent edges, surface portions of the fabric piece form puckers, and wherein the hypothenuse edge is folded to form opposing hypothenuse edge portions that are positioned in a separated but parallel relationship and stitched together to form seamless swells and protrusions on the surface of the fabric piece to form a pillow cavity; and polyester batting being disposed within the pillow cavity.

2. The child's combination pillow and plaything of claim 1 substantially in the shape of a billowy, three-dimensional cloud, and wherein the exterior surface is a fabric that is soft, white, pliant and durable.

3. The child's combination pillow and plaything of claim 1 and further including a random assemblage of swells and protrusions, each swell and protrusion being individually stuffed with tufts of the polyester batting and secured in position with blindstitching.

4. The child's combination pillow and plaything of claim 1 and further including a plurality of randomly positioned depressions and hollows, each secured by thread.

5. The child's combination pillow and plaything of claim 1 and further including a simulated star attached to the fabric surface, the star comprising of iridescent gold stretch fabric and an interior filled with polyester batting.

6. The child's combination pillow and plaything of claim 1 and further including a simulated upturned crescent moon attached to the fabric surface, the moon having a lower arcuate edge and an upper arcuate edge, the upper arcuate edge being unattached to the fabric surface, the moon comprising of iridescent gold stretch fabric filled with polyester batting.

7. The child's combination pillow and plaything of claim 6 and further including a detachable fabric toy angel, the toy angel having a gown-like garment made of fabric commonly associated with sleepwear.

8. The child's combination pillow and plaything of claim 7 and further including a place for securing the detachable fabric toy angel comprising:

a depression in the fabric's surface of sufficient width and depth to receive the toy angel, the depression being located adjacent to the moon such that the angel is secured between the moon and the depression.

9. The child's combination pillow and plaything of claim 1 and further including a detachable fabric toy angel, wherein the toy angel has a gown-like garment made of fabric commonly associated with sleepwear.

10. The child's combination pillow and plaything of claim 9 and further including a place for securing the detachable fabric toy angel comprising:

a depression in the fabric's surface of sufficient width and depth to receive the toy angel.

* * * * *